US012703954B2

(12) United States Patent
Putnam

(10) Patent No.: US 12,703,954 B2
(45) Date of Patent: Aug. 11, 2026

(54) EXTENSION PIPE FOR MANHOLE COVER

(71) Applicant: SEWER SENTRY LLC, Calhoun, LA (US)

(72) Inventor: David Alan Putnam, West Monroe, LA (US)

(73) Assignee: SEWER SENTRY LLC, Calhoun, LA (US)

( * ) Notice: Subject to any disclaimer, the term of this patent is extended or adjusted under 35 U.S.C. 154(b) by 729 days.

(21) Appl. No.: 18/069,007

(22) Filed: Dec. 20, 2022

(65) Prior Publication Data

US 2023/0193580 A1 Jun. 22, 2023

Related U.S. Application Data

(60) Provisional application No. 63/293,003, filed on Dec. 22, 2021.

(51) Int. Cl.
*E02D 29/14* (2006.01)

(52) U.S. Cl.
CPC ..... *E02D 29/14* (2013.01)

(58) Field of Classification Search
CPC ..... E02D 29/14
USPC ..... 404/25, 9, 10
See application file for complete search history.

(56) References Cited

U.S. PATENT DOCUMENTS

| | | | |
|---|---|---|---|
| 193,605 | A | 7/1877 | Hay |
| 574,992 | A | 1/1897 | Held |
| 576,253 | A | 2/1897 | Bingham |
| 1,469,790 | A | 10/1923 | Hysko |
| 2,009,132 | A | 7/1935 | Gehris |
| 2,026,788 | A | 1/1936 | Kirby |
| 3,530,882 | A | 9/1970 | Case et al. |
| 3,712,009 | A | 1/1973 | Campagna |
| 3,798,848 | A | 3/1974 | Campagna |
| 3,920,347 | A | 11/1975 | Sauriol et al. |
| 3,953,554 | A | 4/1976 | Loughridge |
| 3,973,856 | A | 8/1976 | Gaglioti |
| 4,067,659 | A | 1/1978 | Campagna et al. |
| 4,069,840 | A | 1/1978 | Brown et al. |
| 4,103,901 | A | 8/1978 | Ditcher |

(Continued)

FOREIGN PATENT DOCUMENTS

| | | |
|---|---|---|
| CN | 211006763 U | 7/2020 |
| DE | 69 44 309 U | 6/1970 |

(Continued)

OTHER PUBLICATIONS

International Search Report and Written Opinion for International Patent Application PCT/US22/53535 dated May 25, 2023.

(Continued)

*Primary Examiner* — Raymond W Addie
(74) *Attorney, Agent, or Firm* — Foley & Lardner LLP

(57) ABSTRACT

A manhole cover assembly for a sewer, the manhole cover assembly including a manhole cover having a top surface and a bottom surface. An opening extends through the manhole cover between the top surface and the bottom surface. The assembly further includes an extension pipe coaxially aligned with the opening of the manhole cover and extending from the top surface of the manhole cover, wherein the extension pipe is coupled to the manhole cover with a locking mechanism.

17 Claims, 10 Drawing Sheets

(56) References Cited

U.S. PATENT DOCUMENTS

| | | | | |
|---|---|---|---|---|
| 4,305,679 | A | 12/1981 | Modi | |
| 4,440,407 | A | 4/1984 | Gagas | |
| 4,475,571 | A | 10/1984 | Houston, Jr. et al. | |
| 4,501,292 | A | 2/1985 | Maloblocki | |
| 4,512,492 | A * | 4/1985 | Graybeal | E02D 29/14 220/203.28 |
| 4,586,941 | A | 5/1986 | Cooley | |
| 4,597,692 | A | 7/1986 | Gruenwald | |
| 4,650,365 | A * | 3/1987 | Runnels | E02D 29/14 404/26 |
| 4,687,023 | A | 8/1987 | Harbison et al. | |
| 4,762,440 | A | 8/1988 | Argandona | |
| 4,768,675 | A | 9/1988 | Coleman | |
| 4,834,574 | A | 5/1989 | Bowman | |
| 4,919,564 | A | 4/1990 | Neathery et al. | |
| 5,062,735 | A | 11/1991 | Gaudin | |
| 5,092,556 | A * | 3/1992 | Darling | A01G 25/00 116/173 |
| 5,161,958 | A | 11/1992 | Landquist | |
| 5,236,166 | A * | 8/1993 | Darling | A63B 57/505 473/150 |
| 5,401,114 | A | 3/1995 | Guggemos | |
| 5,509,445 | A | 4/1996 | Couet | |
| 5,601,111 | A | 2/1997 | Sodergard | |
| 5,727,351 | A | 3/1998 | Neathery et al. | |
| 5,846,274 | A | 12/1998 | Smelser | |
| 5,924,846 | A | 7/1999 | Arnold et al. | |
| 6,161,984 | A | 12/2000 | Sinclair | |
| 6,510,869 | B1 | 1/2003 | Ouchi et al. | |
| 6,514,008 | B1 | 2/2003 | Smolnik | |
| 6,616,370 | B1 * | 9/2003 | Signorelli | E02D 29/14 404/25 |
| 6,848,465 | B1 | 2/2005 | Ledbetter | |
| 6,945,731 | B1 * | 9/2005 | Vait | G09F 17/00 248/560 |
| 7,798,742 | B2 | 9/2010 | Nolle et al. | |
| 7,849,617 | B2 | 12/2010 | Intagliata et al. | |
| 7,883,290 | B1 | 2/2011 | Ross et al. | |
| 8,256,444 | B2 | 9/2012 | Pietras et al. | |
| 8,851,789 | B2 | 10/2014 | Bax | |
| 8,851,791 | B1 * | 10/2014 | Putnam | E02D 29/14 404/25 |
| 9,091,367 | B2 | 7/2015 | Waldor | |
| 9,605,403 | B1 * | 3/2017 | Putnam | E02D 29/14 |
| 9,695,569 | B1 | 7/2017 | Knowles | |
| 9,784,650 | B1 | 10/2017 | Neathery | |
| 11,118,323 | B1 * | 9/2021 | Putnam | E02D 29/14 |
| 11,280,285 | B2 * | 3/2022 | Nose | F02D 41/025 |
| D964,876 | S * | 9/2022 | Galli | D10/30 |
| 11,536,003 | B1 | 12/2022 | Forlong et al. | |
| 2008/0105306 | A1 | 5/2008 | Takai | |
| 2008/0295375 | A1 * | 12/2008 | Intagliata | G09F 15/0037 116/63 P |
| 2009/0223574 | A1 | 9/2009 | Montague | |
| 2012/0048401 | A1 | 3/2012 | Yamashita et al. | |
| 2012/0227168 | A1 | 9/2012 | Paoluccio et al. | |
| 2013/0019794 | A1 * | 1/2013 | Neal | E04H 12/2223 248/314 |
| 2013/0089373 | A1 | 4/2013 | Bax | |
| 2014/0137949 | A1 | 5/2014 | Montague | |
| 2016/0356522 | A1 | 12/2016 | Bertini et al. | |
| 2018/0100600 | A1 | 4/2018 | Sugai | |
| 2021/0246992 | A1 | 8/2021 | Ford | |
| 2022/0112678 | A1 | 4/2022 | Putnam | |
| 2023/0265637 | A1 | 8/2023 | Putnam | |

FOREIGN PATENT DOCUMENTS

| | | | |
|---|---|---|---|
| DE | 36 37 493 | A1 | 5/1988 |
| DE | 20213650 | U1 | 12/2002 |
| DE | 10 2006 054 343 | B3 | 1/2008 |
| DE | 10 2006 045 873 | A1 | 4/2008 |
| EP | 1 655 416 | A2 | 5/2006 |
| JP | 2001-220765 | A | 8/2001 |
| JP | 2005-179965 | A | 7/2005 |
| JP | 2011-111856 | A | 6/2011 |
| JP | 2013-256760 | A | 12/2013 |
| KR | 10-0917273 | B1 | 9/2009 |
| KR | 10-2009-0114740 | A | 11/2009 |
| KR | 20110093249 | A | 8/2011 |
| KR | 10-2013-0047119 | A | 5/2013 |
| WO | WO-92/09753 | A1 | 6/1992 |
| WO | WO-2018/143963 | | 8/2018 |

OTHER PUBLICATIONS

Stainless Steel Sanitary Tubing—5 Foot Lengths. Datasheet [online], Buy Fittings Online, Oct. 6-7, 25, 2021 [retrieved Mar. 17, 2023]. Entire Document. Retrieved from the Internet: https://www. buyfittingsonline.com/stainless-steel-sanitary-tubing-5-ft-length-pre-cut/.

International Search Report and Written Opinion in PCT/US2024/027031 dated Aug. 28, 2024.

Gromicko, Nick and Will Decker. "Standpipes." NAHI, InterNACHI, Aug. 22, 2010. Web. https//www.nachi.org/standpipes.htm.

International Search Report and Written Opinion for International Patent Application No. PCT/US2021/049918 Dtd Dec. 22, 2021.

International Search Report and Written Opinion for International Patent Application No. PCT/US2021/054279 dated Jan. 19, 2022.

International Search Report dated Apr. 28, 2017 in PCT/US2017/15908, 3 pages.

Extended European Search Report on EP Patent Application No. 21880825.1 Dtd Oct. 22, 2024, 12 pgs.

Extended European Search Report on EP 22912396 dated Dec. 2, 2025, 10 pgs.

* cited by examiner

EXTENSION PIPE FOR MANHOLE COVER

CROSS-REFERENCE TO RELATED APPLICATION

This application claims priority to U.S. Provisional Application No. 63/293,003 filed on Dec. 22, 2021, entitled "Extension Pipe for Manhole Cover", the entire contents of which are incorporated herein by reference.

TECHNICAL FIELD

This disclosure relates to the manhole cover assemblies, and in particular, to an extension pipe coupled to the manhole cover.

BACKGROUND

Sewer systems provide a discharge means to transport disposed wastewater to, for example, water treatment facilities or other discharge stations. Sewer systems include underground pipes or passageways, which are laid horizontally to a surface of the ground. These passageways are connected to sewer risers, through which an access to the sewer system is provided. Sewer risers extend generally vertically from the passageways and include a manhole opening that is enclosed with a manhole cover to prevent access to or persons from accidentally falling into the sewer system. The manhole cover is usually at or below the surrounding ground surface and includes a relatively small-size opening for ventilation of sewer gases.

In use, the opening oftentimes becomes blocked by debris and dirt preventing and/or reducing sewer gas ventilation. In addition, rainwater, snow, or other fluids can accumulate over the ground surface and enter and/or block the opening.

Additionally, in overgrown grassy areas or areas with excessive vegetation or large accumulations of snow, it is difficult for the maintenance personnel to locate the manhole cover.

SUMMARY

According to a first aspect, there is provided a manhole cover assembly having a manhole cover with a top surface and a bottom surface. The manhole cover includes an opening extending through the manhole cover between the top surface and the bottom surface. The manhole cover assembly includes an extension pipe aligned with the opening of the manhole cover and extending from the top surface of the manhole cover. The extension pipe of the manhole cover assembly is coupled to the manhole cover with a locking mechanism.

In some embodiments, the locking mechanism is a threadedly secured connection between the extension pipe and the manhole cover.

In other embodiments, the locking mechanism is a snap-fit connection between the extension pipe and the manhole cover.

In still other embodiments, the extension pipe is integrally formed with the manhole cover.

In yet other embodiments, a length of the extension pipe is about 5 feet.

In still other embodiments, the extension pipe is formed of metal.

In yet another embodiment, the extension pipe is formed of plastic.

According to another embodiment, the extension pipe includes a hinge. The hinge is disposed between and connects a first section of the extension pipe to a second section of the extension pipe in such a way that the first section moves relative to the second section.

In still other embodiments, the hinge is a biasing mechanism.

In another embodiment, the hinge is a rubber sleeve.

In some embodiments, the hinge is integrally formed with the extension pipe.

In yet another embodiments, the extension pipe is a hollow cylindrical member.

BRIEF DESCRIPTION OF THE DRAWINGS

The subject matter of the present disclosure is particularly pointed out and distinctly claimed in the concluding portion of the specification. A more complete understanding of the present disclosure, however, is best be obtained by referring to the detailed description and claims when considered in connection with the drawing figures, wherein like numerals denote like elements.

DETAILED DESCRIPTION

Figure 1:
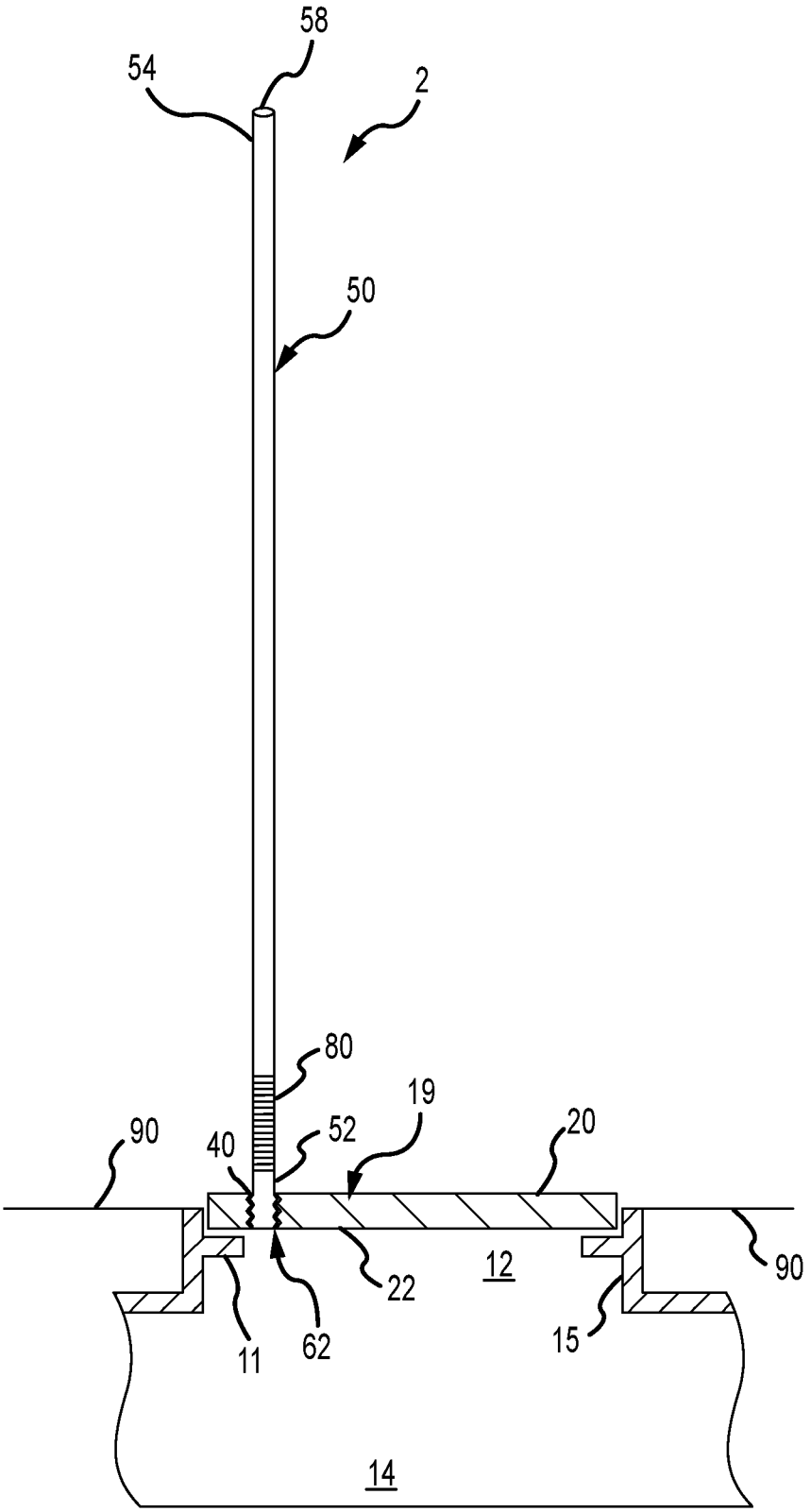
FIGS. 1 and 2 illustrate fragmented section views of the manhole cover assembly with the extension pipe threadedly secured to the manhole cover.
Figure 2:
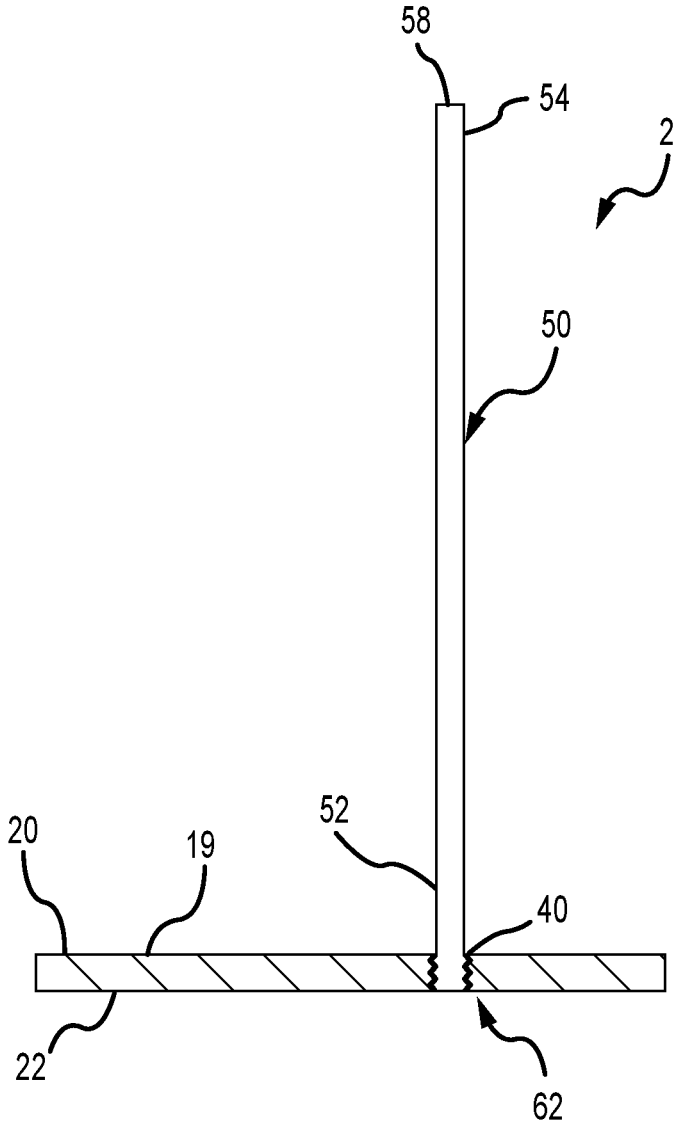
Figure 3:
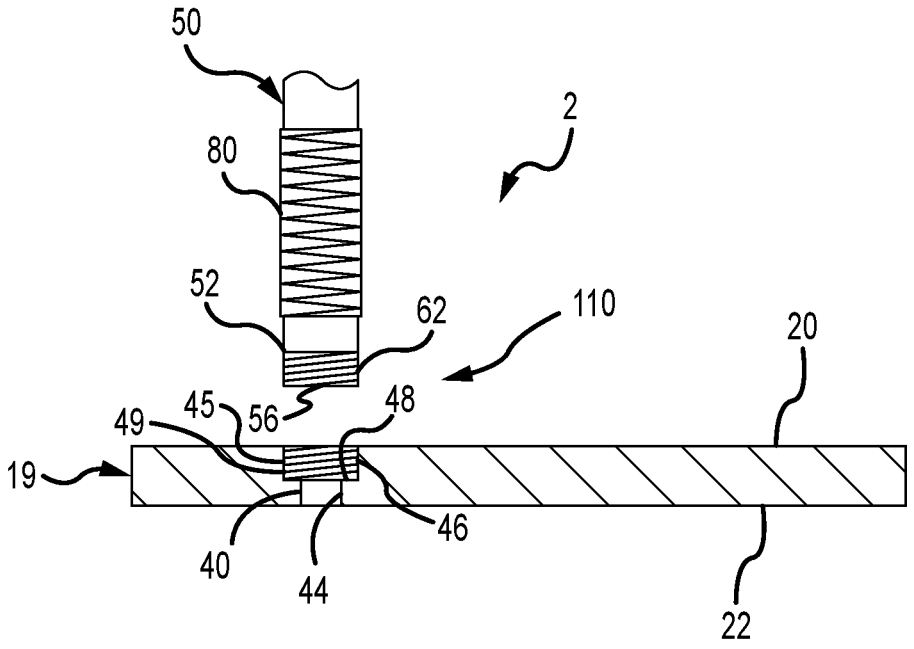
FIG. 3 is a detail exploded view of a portion of the manhole cover of FIG. 1 illustrating the extension pipe detached from the manhole cover.
Figure 4:
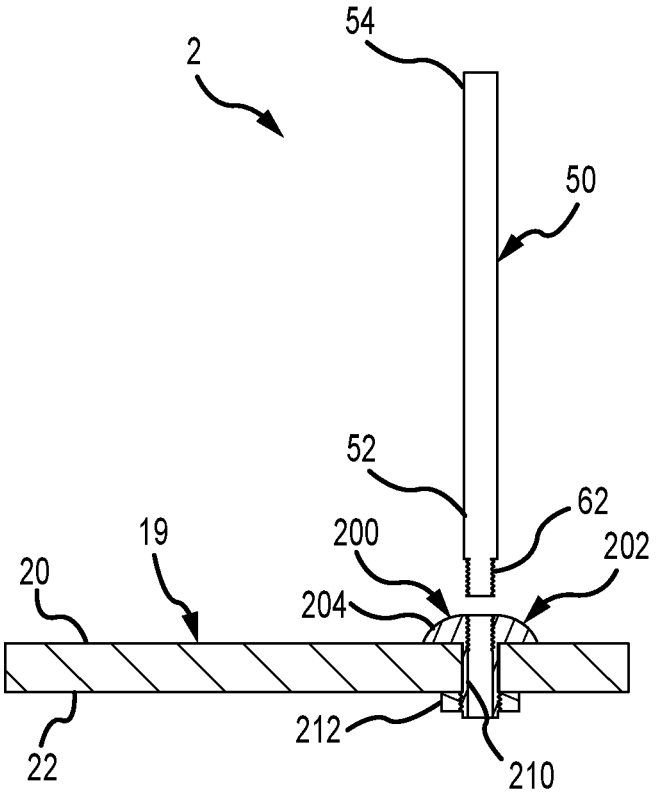
FIG. 4 is a fragmented section view of the manhole cover having a mounting assembly, wherein the extension pipe with a threaded end is detached from the mounting assembly.

FIGS. 1, 2, and 3 are illustrations of a manhole cover assembly 2 in which manhole cover 19 employs a flexible extension pipe 50 to advantage. In the embodiment illustrated in FIGS. 1, 2, and 3, the manhole cover 19 is formed having a top surface 20 and a bottom surface 22 and an opening 40 extending between the top surface 20 and the bottom surface 22. As illustrated in FIG. 3, the extension pipe 50 is coaxially aligned with the opening 40 and extends upward/outward from the top surface 20. As explained in greater detail below, in such embodiment, the extension pipe 50 is configured to be inserted directly into the opening 40 of the manhole cover 19. In use, the manhole cover assembly 2 provides access to a sewer 14 through a manhole opening 12 (FIG. 1). The manhole opening 12 is formed having a sidewall 15 and a shoulder 11 extending radially inward from the sidewall 15 to support the manhole cover 19 thereon.

Referring specifically to FIG. 3, the opening 40 of the manhole cover 19 is formed having a sidewall 44, a portion of which includes a threaded portion 45 such that, as explained in greater detail below, corresponding threading on the extension pipe 50 can threadingly engage the threaded portion 45 in order to securely fasten the extension pipe 50 to the manhole cover 19. In some embodiments, the opening 40 optionally includes a seat shoulder 48 to provide support to the extension pipe 50 when securely fastened therein.

According to embodiments disclosed herein, the extension pipe 50 is a hollow cylindrical pipe having openings 56 and 58 on respective ends 52 and 54. When the extension pipe 50 is secured to the manhole cover 19, access to the opening 40 of the manhole cover 19 is provided through the opening 58, which is spaced apart from of the top surface 20 of the manhole cover 19. Accordingly, fluids (rainwater, etc.) and debris (dirt, etc.) that accumulate on the ground surface 90 are prevented from directly entering the opening 40 on the manhole cover 19 until such accumulation exceeds the height of the extension pipe 50. Put another way, the height of the extension pipe 50 prevents or substantially reduces fluids and debris from entering the sewer 14 through the opening 40 by effectively raising or otherwise spacing the opening 40 apart from the top surface 20 of the manhole cover 19.

In addition to guarding the sewer 14 from fluids and debris, the extension pipe 50 provides a means to continuously vent the sewer 14 in order to allow the continuous discharge of sewer gases to the atmosphere. In particular, when debris, dirt, or the like accumulate above the ground surface 90 (FIG. 1), such substances may block the opening 40 of the manhole cover 19 without the use of the extension pipe 50. Thus, through the use of the extension pipe 50 spacing the entrance of the opening 40 from the top surface 20 of the manhole cover 19, venting of the sewer 14 can continue when the debris and dirt accumulate above the ground surface 90. Without the extension pipe 50, the debris and dirt may block the entrance into the opening 40 of the manhole cover 19, thus, preventing or substantially reducing a ventilation of the sewer 14.

Additionally, the extension pipe 50 facilitates a more efficient locating of the manhole cover 19 in areas of dense vegetation and/or in areas where there is an excessive accumulation of snow or other dirt and debris, which can prevent or substantially reduce the visibility of the manhole cover 19. In particular, the height and/or a distinctive color of the extension pipe 50 allows a user to more easily locate the manhole cover 19.

According to some embodiments, a height of the extension pipe 50 may be 0.152 meters, 0.914 meters, or 1.524 meters (½, 3, or 5 feet). However, it should be understood that other embodiments of the extension pipe 50 may have taller or shorter heights. Additionally, the extension pipe 50 may be formed of any type or rigid, substantially rigid, or flexible materials and/or combinations thereof. For example, extension pipe 50 may be formed of fiberglass, metal, plastic, rubber, or any other rigid or semi-rigid material or combinations thereof. Additionally, in some embodiments, the extension pipe 50 may be formed of the same material type having different stiffness properties and/or two or more different materials having different stiffness properties, in each case to enable flexibility.

Figure 7:
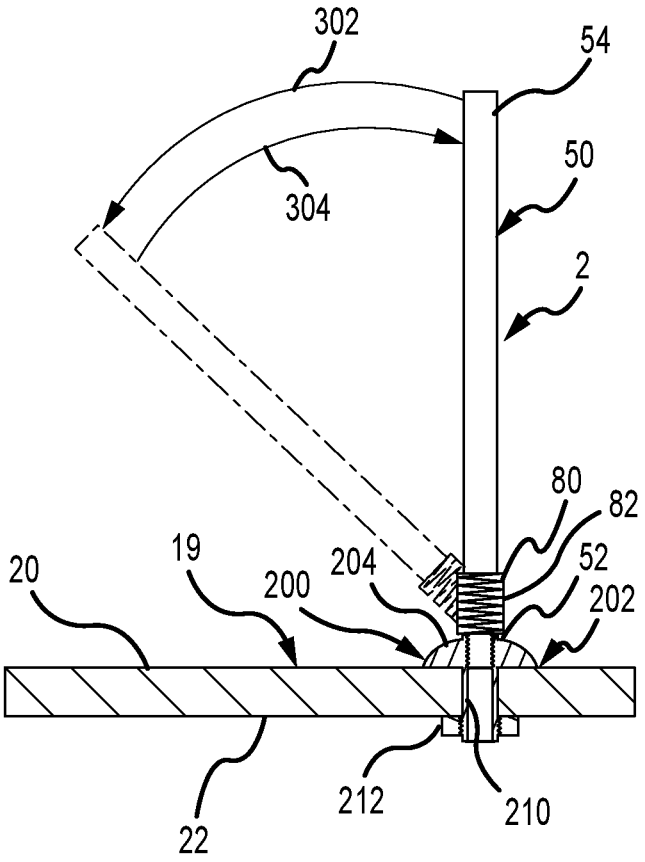
FIG. 7 illustrates an operation of a hinge mechanism of the extension pipe secured to the mounting assembly.
Figure 8:
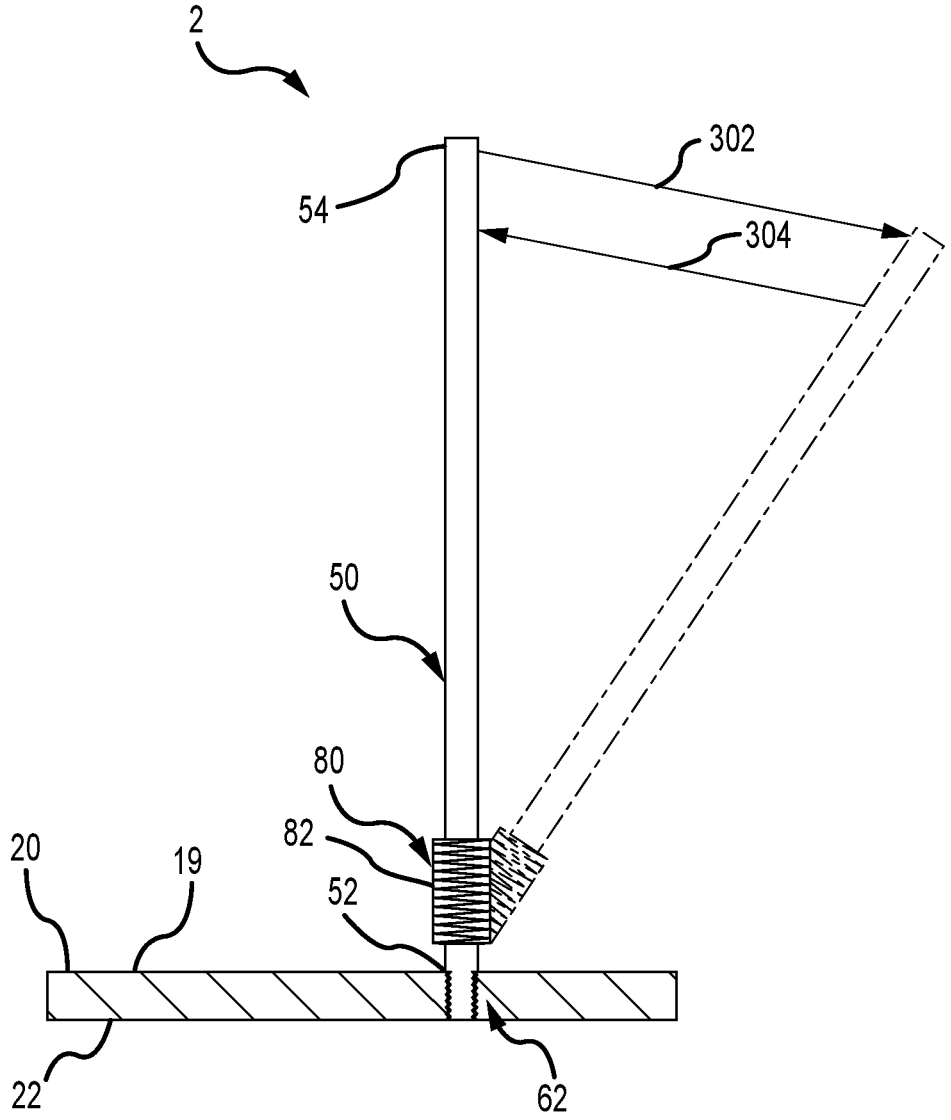
FIG. 8 illustrates an operation of a hinge mechanism of the extension pipe secured to the manhole cover.

In the embodiment illustrated in FIGS. 1 3, 7, 8, 9*a* and 9*b*, the extension pipe 50 is formed having a hinge mechanism 80. When installed, the hinge mechanism 80 provides a flexibility to enable bending movement of the extension pipe 50 when external forces act on or are otherwise applied against the extension pipe 50. For example, as FIGS. 7 and 8 illustrate, when a bending force is applied to the extension pipe 50, for example, in the direction of arrow 302, from snow or dirt buildup, vehicles passing over it, etc., the hinge mechanism 80 allows the extension pipe 50 to pivot and/or otherwise bend in order to prevent or substantially reduce the likelihood of the extension pipe 50 snapping, bending or being permanently damaged when the external force acts against the extension pipe 50. When the force ceases to act on the extension pipe 50, the hinge mechanism 80 enables the extension pipe 50 to pivot, for example, in the direction of arrow 304, and then return to its original static position such as, for example, generally upright (i.e., extending substantially perpendicular to the manhole cover top surface 20) or any other desired or necessary position to properly function.

According to some embodiments, the hinge mechanism 80 is a biasing mechanism such as a spring 82 to facilitate bending movement of the extension pipe 50. In the embodiment illustrated in FIG. 9*a* by way of example, the spring 82 may be a torsion spring; however, it should be understood that any other type of spring that functions to provide the flexibility may be utilized. With continued reference to FIG. 9*a*, the spring 82 is disposed between and connects two separate segments 50*a*, 50*b* of the extension pipe 50. In other embodiments, the spring 82 may be integrally formed (for example, through molding) into a portion of the extension pipe 50 that is formed entirely from a flexible material. In other embodiments, the extension pipe 50 may be entirely formed as a spring 82 such that the spring coils extend between first and second ends 52 and 54. In other embodiments, extension pipe 50 may be formed substantially of a spring 82 (i.e., more than half of the extension pipe 50). However, it should be understood that the spring 82 may extend any desired length.

Figure 9A:
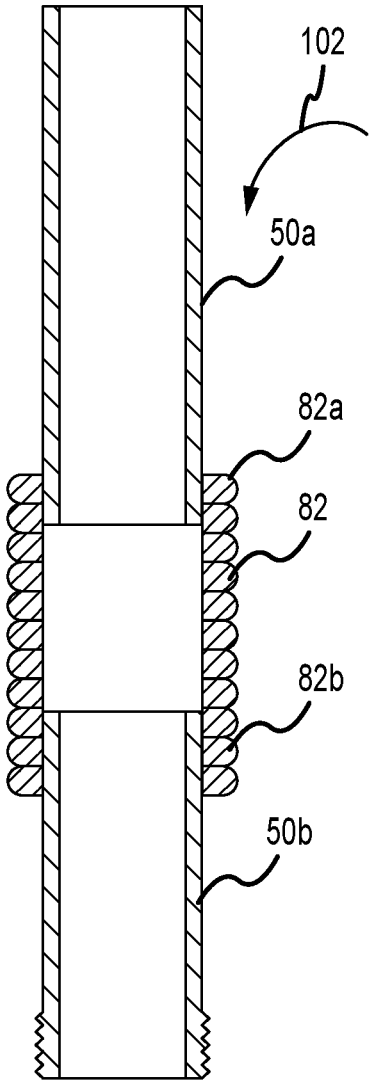
FIGS. 9*a* and 9*b* illustrate embodiments of the hinge mechanism.

Referring specifically to FIG. 9*a*, spring 82 is positioned between and connects the segments 50*a* and 50*b*. In particular, the spring 82 is cylindrical and of a sufficient stiffness to support the segments 50*a* and 50*b* such that they are co-axially aligned, but flexible enough to enable the segment 50*a* to move relative to segment 50*b*, such as for example, as indicated by arrow 102. In the embodiment illustrated in FIG. 9*a*, each end 82*a* and 82*b* of the spring 82 overlaps and frictionally engages respective portions of the outer surfaces of segments 50*a* and 50*b* to prevent separation thereof. It should be understood, however, that other means of attaching the spring 82 to the segments 50*a* and 50*b* may be used such as mechanical fasteners (screws, bands/clamps, etc.) and adhesives, by way of example.

According to some embodiments, the hinge mechanism 80 may be a living hinge 84. For example, the living hinge 84 that connects first and second segments 50*a* and 50*b* may be formed of a flexible material capable of bending while the first and second segments 50*a* and 50*b* are formed of a more rigid material. Thus, by way of example, first and second segments 50*a* and 50*b* may be formed of a metallic material or rigid plastic pipe, such as, for example, polyvinyl chloride (PVC) pipe and the biasing mechanism may be made of a rubber material such that when a force acts on the extension pipe 50, the rubber material enables the segment 50*a* to bend relative to the segment 50*b*.

Figure 9B:
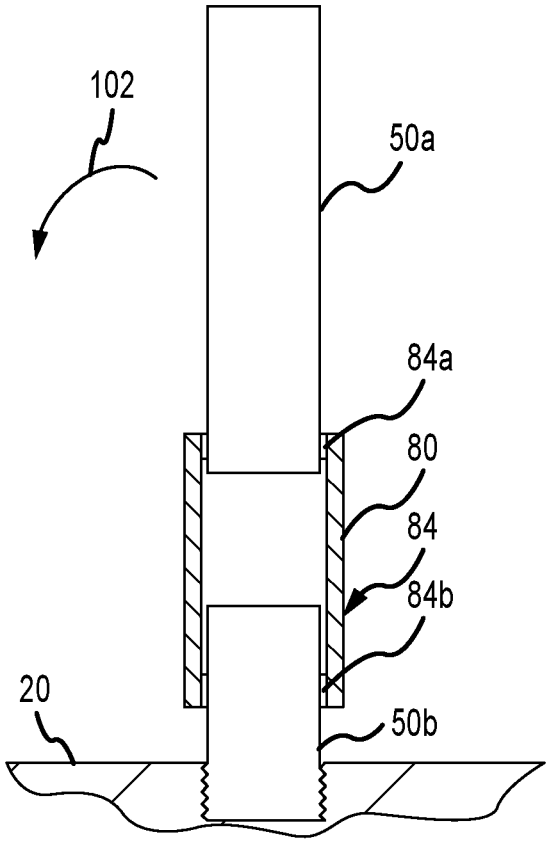

Referring to the embodiment illustrated in FIG. 9*b*, the living hinge 84 is a rubber sleeve positioned between and connecting the segments 50*a* and 50*b*. In particular, the rubber sleeve is a cylindrical generally flexible member having a stiffness to support the segments 50*a* and 50*b* such that they are co-axially aligned but flexible enough to enable the segment 50*a* to move relative to segment 50*b*, such as for example, as indicated by arrow 102. In the embodiment illustrated in FIG. 9*b*, each end 84*a* and 84*b* of the sleeve overlaps and frictionally engages respective portions of the outer surfaces of segments 50*a* and 50*b* to prevent separation thereof. It should be understood, however, that other means of attaching the living hinge 84 to the segments 50*a* and 50*b* may be used, such as mechanical fasteners (screws, bands/clamps, etc.) and adhesives, by way of example.

According to some embodiments, the manhole cover assembly 2 can optionally include the mounting assembly 200, which can be used to secure the extension pipe 50 to the manhole cover 19, as illustrated for example in FIGS. 4, 5, 6*a*, 6*b*, 7, 11, and 12. As specifically illustrated in the embodiment in FIGS. 11 and 12, the mounting assembly 200 includes a base member 202 having an arcuate or dome-like top surface 204 and a mounting stem 206 extending from a bottom surface 208 of the base member 202. As illustrated, the base member 202 includes a passageway 210 extending from the top surface 204 through the entirety of the mounting stem 206 and, as discussed in greater detail below, is sized to receive and otherwise engage with the extension pipe 50. The mounting stem 206 includes an outer surface 209 sized to fit within the opening 40 and extends beyond the bottom surface 22 (FIG. 12) of the manhole cover 19 so that it can receive a threaded bolt/nut 212 to secure the mounting assembly 200 to the manhole cover 19. It should be understood, however, that other means of securing can be used, such as an adhesive, a cotter pin, a friction fit, and the like.

Figure 12:
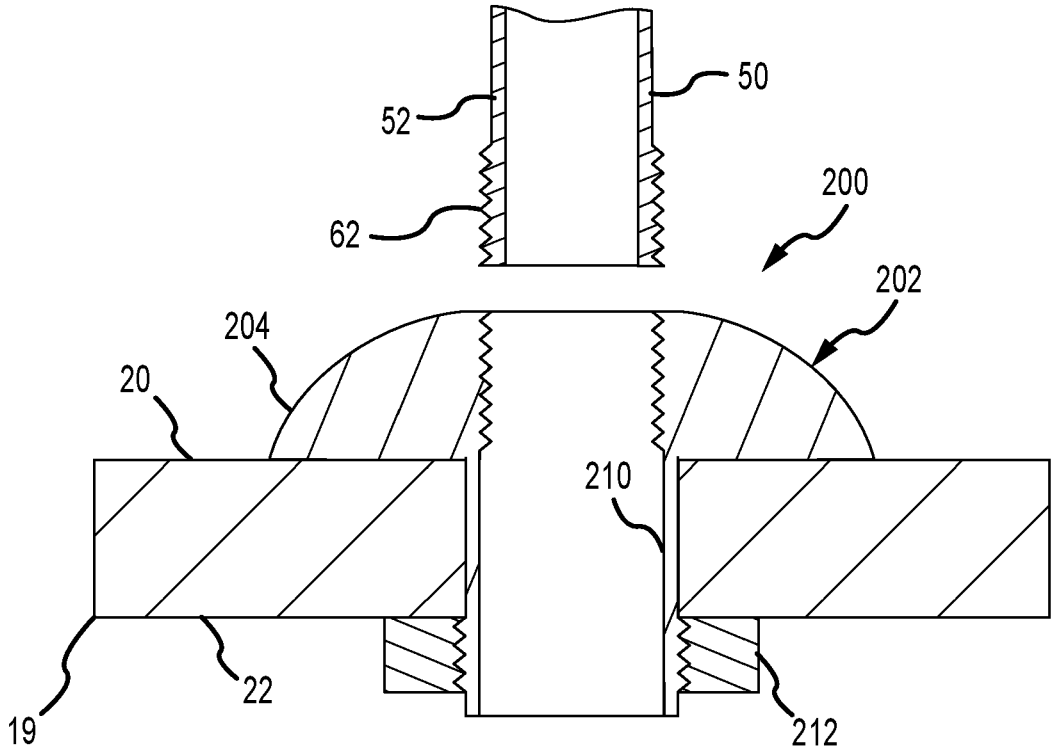
FIG. 12 illustrates the mounting assembly of FIG. 11 secured to a manhole cover.

With particular reference to FIG. 12, the passageway 210 is appropriately sized to receive the extension pipe 50, which can be similarly secured to the mounting assembly 200, as previously described. It should be understood that the mounting assembly 200 can be used to retrofit existing manhole covers 19, and in other embodiments, can be formed integrally with the manhole covers 19, in which case the mounting stem 206 can be omitted.

According to some embodiments, the extension pipe 50 is removably attachable to the manhole cover 19 via a locking mechanism 110. In the embodiment illustrated in FIGS. 1, 2, and 3, for example, the locking mechanism 110 includes a threaded attachment. In particular, the locking mechanism 110 includes threaded portion 45 formed in a seat 46 of the opening 40 and corresponding threads 62 on the extension pipe 50. For example, FIG. 3 illustrates the threaded portion 45 extending from a seat shoulder 48 throughout a seat sidewall 49. As such, when it is desired to install or remove from the manhole cover 19, the extension pipe 50 is rotated clockwise or counterclockwise relative to the manhole cover 19. It should be understood that other locking mechanisms 110 can be used. For example, a snap-fit connection, discussed more fully below, a connection using nut and bolt, a friction fit, or the like can be used. In other embodiments, the extension pipe 50 may be formed integrally with the manhole cover 19 thereby avoiding the need for a locking mechanism 110.

Figure 5:
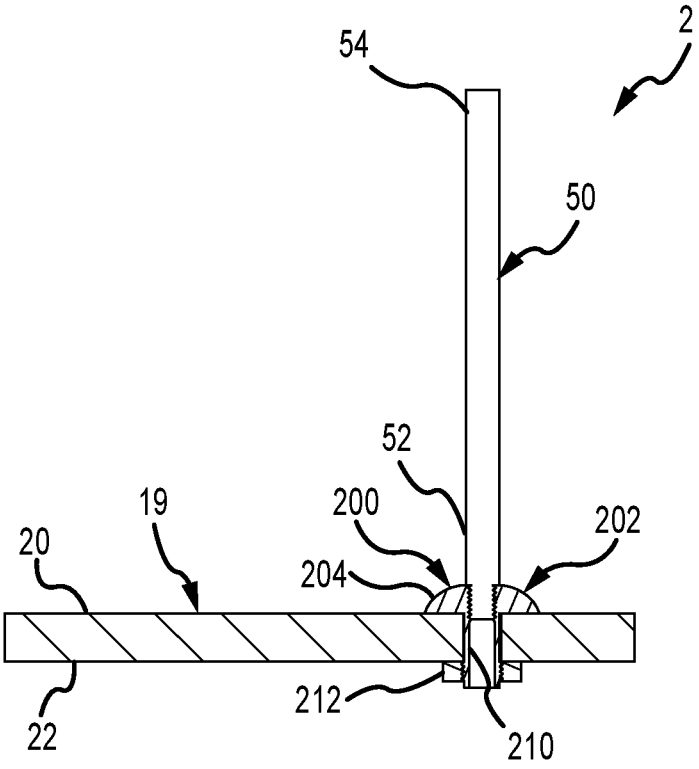
FIG. 5 is a fragmented section view of the manhole cover having a mounting assembly, wherein the extension pipe is frictionally secured to the mounting assembly.
Figure 6A:
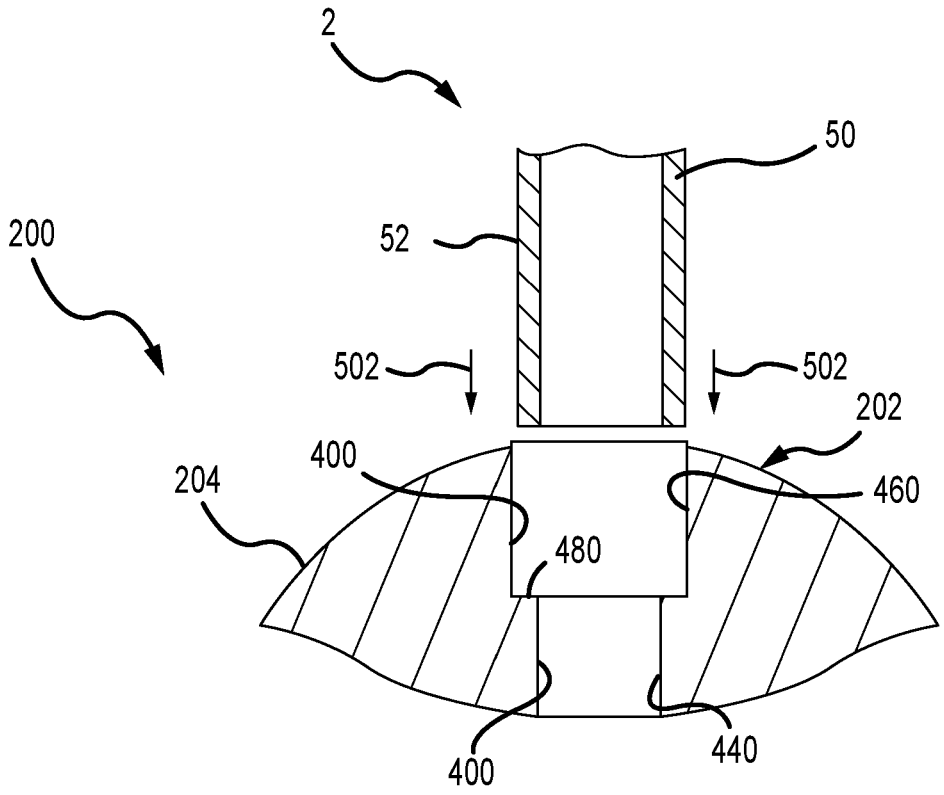
FIGS. 6*a* and 6*b* illustrate embodiments of the mounting assembly having a seat for disposing at least one end of the extension pipe therein.
Figure 6B:
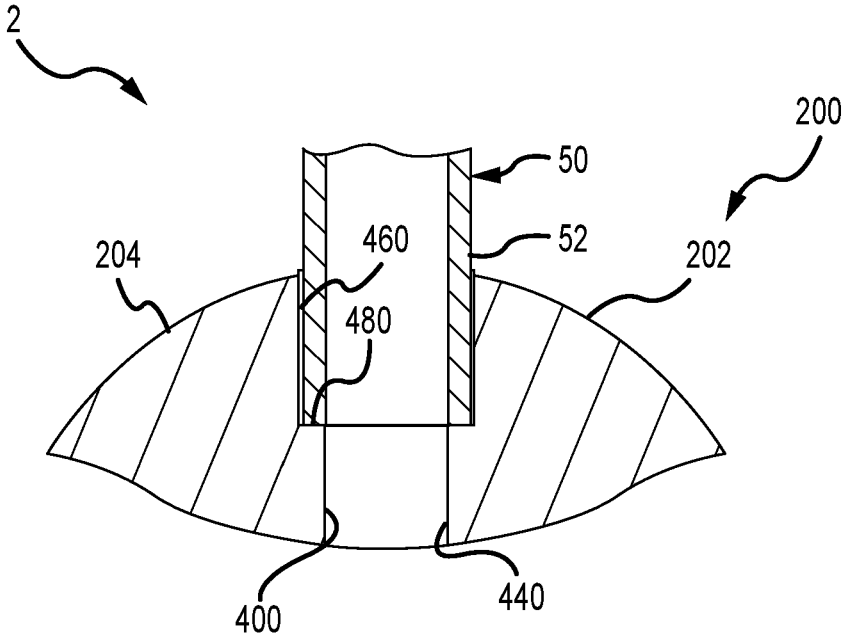

In some embodiments, the extension pipe 50 is frictionally secured to the mounting assembly 200 as illustrated for example, in FIGS. 5, 6*a*, and 6*b*. Referring specifically to FIGS. 6*a* and 6*b*, the opening 400 of the mounting assembly 200 is formed having a sidewall 440. In some embodiments, the opening 400 optionally includes a seat 460 and a seat shoulder 480 to provide support to the extension pipe 50 when it is frictionally secured therein. For example, FIG. 6*a* illustrates a detail view of the manhole cover assembly 2, wherein the end 52 of the extension pipe 50 is inserted into the mounting assembly 200 until a face of the end 52 rests on the seat shoulder 480 as illustrated in FIG. 6*b*. One of ordinary skill in the art appreciates that the extension pipe 50 may be frictionally secured to the sidewall 440 of the mounting assembly 200 that does not have the seat 460 and the seat shoulder 480.

Figure 10:
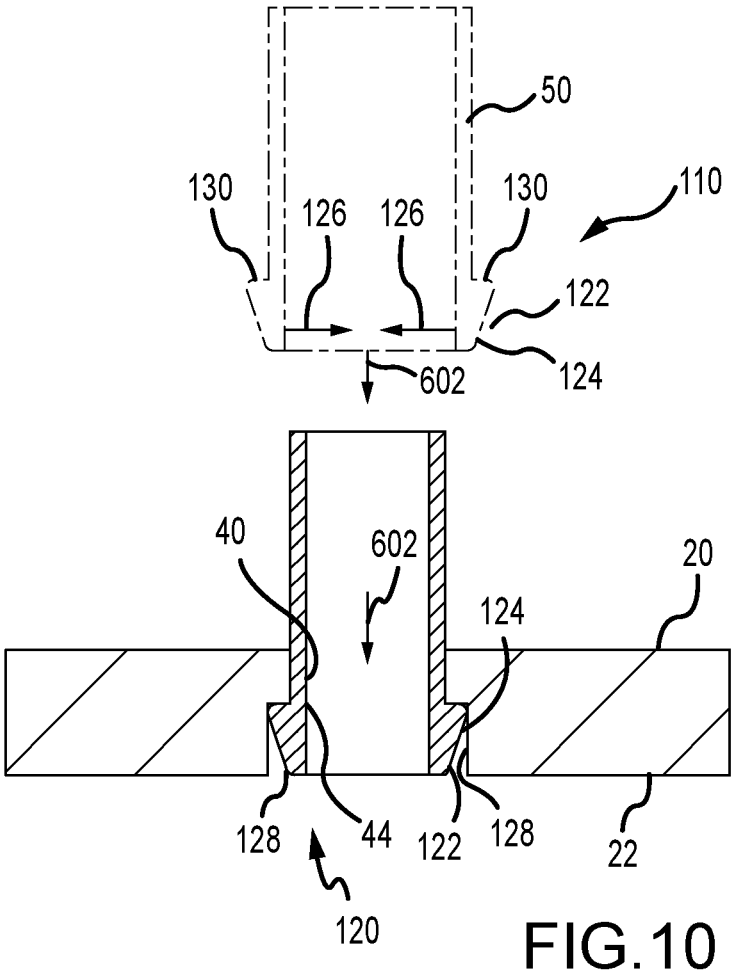
FIG. 10 is a detail view of a locking mechanism for securing the extension pipe to the manhole cover.
Figure 11:
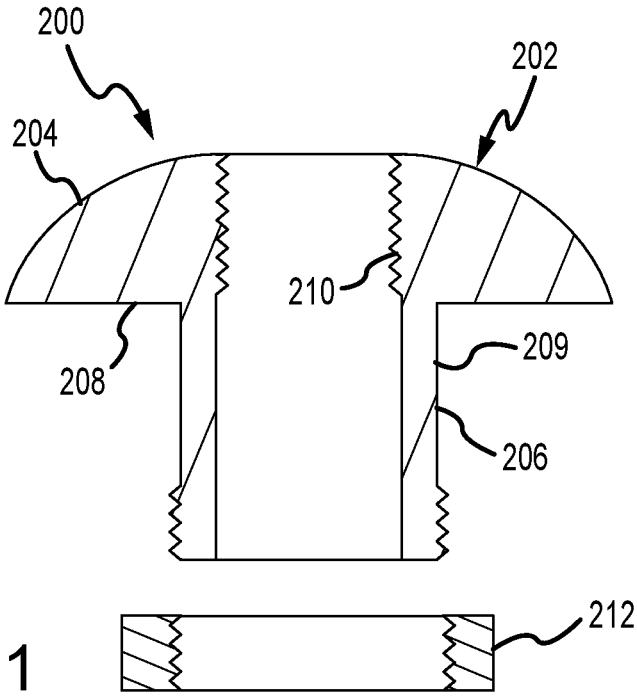
FIG. 11 is an exploded view of the mounting assembly.

FIG. 10 illustrates the extension pipe 50 coupled to the manhole cover 19 with a snap-fit connection. However, one of ordinary skill in the art appreciates that the extension pipe 50 may be secured to the manhole cover 19 and/or to the mounting assembly 200 via any other means. For example, in some embodiments the extension pipe 50 may be frictionally secured to the manhole cover 19 and/or to the mounting assembly 200 as described herein. In other embodiments the extension pipe 50 may be molded or integrally formed via any other means either with the manhole cover 19 and/or with the mounting assembly 200. Additionally, the mounting assembly 200 can be removably engaged or integrally formed with the manhole cover 19 in a similar way as the extension pipe 50 can be removably or integrally coupled to the mounting assembly 200 and/or to the manhole cover 19.

In the embodiment illustrated in FIG. 10, the locking mechanism 110 includes a snap fit/tongue and groove connection 120. For example, in FIG. 10, the extension pipe 50 includes a flexible extension member/tongue 122 having an outer surface 124 that is configured to slideably engage the sidewall 44 of the opening 40. In particular, when the extension pipe 50 is inserted into the opening 40 in the direction of arrow 602, the outer surface 124 of the flexible extension member 122 engages the sidewall 44 and inwardly deforms the flexible extension member 122 in the direction of arrows 126 until the extension is disposed within a corresponding groove 128 in the manhole cover 19. Once inside the groove 128, the flexible extension member 122 returns to its original static position such that an upper surface 130 of the flexible extension member 122 engages the groove 128 to lock the extension pipe 50 to the manhole cover 19. While FIG. 10 illustrates a flexible extension member 122 extended from the extension pipe 50 and groove 128 disposed in the manhole cover 19, one of ordinary skill in the art appreciates that the flexible extension member 122 may be disposed in the manhole cover 19 and the groove 128 may be disposed in the extension pipe 50.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments and it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

The invention claimed is:

1. A manhole cover assembly for a sewer, the manhole cover assembly comprising:

a manhole cover having a top surface and a bottom surface;

an opening of the manhole cover extending through the manhole cover between the top surface and the bottom surface;

an extension pipe having a first end and a second end and a hollow interior extending between the first end and the second end, the extension pipe coaxially aligned with the opening of the manhole cover and extending from the top surface of the manhole cover, wherein the extension pipe is coupled to the manhole cover with a locking mechanism; and a threaded locking mechanism securing the first end of the extension pipe to the manhole cover.

2. The manhole cover assembly of claim 1, wherein the threaded locking mechanism includes threads disposed on an outer surface of the extension pipe to secure the extension pipe to the manhole cover.

3. The manhole cover assembly of claim 1, wherein the extension pipe of further comprises a hinge, the hinge disposed between and connecting the hollow interior of a first section of the extension pipe to the hollow interior of a second section of the extension pipe forming a continuous hollow interior extending between the first end and the second end, the hinge configured such that the first section moves relative to the second section.

4. The hinge of claim 3, wherein the hinge is integrally formed with the extension pipe.

5. The manhole cover assembly of claim 1, wherein the opening includes a threaded interior.

6. The manhole cover assembly of claim 1, wherein a length of the extension pipe is 5 feet.

7. The manhole cover assembly of claim 1, wherein the extension pipe is formed of metal.

8. The manhole cover assembly of claim 1, wherein the extension pipe is formed of plastic.

9. The hinge of claim 3, wherein the hinge is a rubber sleeve.

10. The hinge of claim 3, wherein the hinge is a biasing mechanism.

11. A mounting assembly for use with a manhole cover, the mounting assembly comprising:

an extension pipe having a first end and a second end and a hollow interior extending between the first end and the second end;

a base member having an arcuate top surface and a mounting stem extending from a bottom surface of the base member, the mounting stem having a length and a diameter sized to be fit within and extend beyond a corresponding opening within the manhole cover, the base member including a passageway extending from the arcuate top surface through an entirety of the mounting stem and sized to receive the extension pipe therein; and a first threaded locking mechanism to secure the base member to the manhole cover and a second threaded locking mechanism to secure the extension pipe to the base member.

12. The mounting assembly of claim 11, wherein the first threaded locking mechanism of includes a bolt.

13. The mounting assembly of claim 11, wherein the extension pipe is a hollow cylindrical member.

14. The mounting assembly of claim 11, wherein the extension pipe includes a hinge, the hinge disposed between and connecting a first section of the extension pipe to a second section of the extension pipe such that the first section moves relative to the second section.

15. The hinge of claim 14, wherein the hinge is a biasing mechanism.

16. The hinge of claim 14, wherein the hinge is a rubber sleeve.

17. The hinge of claim 14, wherein the hinge is integrally formed with the extension pipe.

* * * * *